US011686128B2

(12) United States Patent
Arnold

(10) Patent No.: US 11,686,128 B2
(45) Date of Patent: Jun. 27, 2023

(54) LOCKING AND UNLOCKING TOOL BOXES AND TOOL CABINETS

(71) Applicant: Pimp My Box Ltd, Aldershot (GB)

(72) Inventor: Karl Arnold, Aldershot (GB)

(73) Assignee: PIMP MY BOX LTD., Aldershot (GB)

( * ) Notice: Subject to any disclaimer, the term of this patent is extended or adjusted under 35 U.S.C. 154(b) by 198 days.

(21) Appl. No.: 17/375,041

(22) Filed: Jul. 14, 2021

(65) Prior Publication Data

US 2022/0018163 A1 Jan. 20, 2022

(30) Foreign Application Priority Data

Jul. 16, 2020 (GB) ..... 2011011

(51) Int. Cl.

| | |
|---|---|
| ***E05B 65/467*** | (2017.01) |
| ***E05B 47/00*** | (2006.01) |
| ***E05B 47/06*** | (2006.01) |
| *E05B 15/00* | (2006.01) |

(52) U.S. Cl.

CPC ..... *E05B 65/467* (2013.01); *E05B 47/0012* (2013.01); *E05B 47/0603* (2013.01); *E05B 15/0046* (2013.01); *E05B 2047/0016* (2013.01); *E05B 2047/0024* (2013.01); *E05B 2047/0036* (2013.01); *E05B 2047/0037* (2013.01); *E05B 2047/0054* (2013.01)

(58) Field of Classification Search

CPC ..... E05B 65/467; E05B 47/0012; E05B 47/0603; E05B 15/0046; E05B 2047/0016; E05B 2047/0024; E05B 2047/0036; E05B 2047/0037; E05B 2047/0054

See application file for complete search history.

(56) References Cited

U.S. PATENT DOCUMENTS

| | | | | |
|---|---|---|---|---|
| 6,374,649 | B1 * | 4/2002 | Holcomb | G07C 9/00182 312/215 |
| 2008/0061564 | A1 * | 3/2008 | Hapke | G07F 9/10 292/201 |
| 2018/0216364 | A1 * | 8/2018 | Wind | E05B 1/0007 |
| 2018/0340350 | A1 * | 11/2018 | Johnson | G07C 9/00944 |

(Continued)

FOREIGN PATENT DOCUMENTS

| | | | | |
|---|---|---|---|---|
| CA | 2788643 | A1 * | 8/2011 | B25H 3/028 |
| CA | 2987088 | A1 * | 6/2018 | E05F 15/76 |

(Continued)

*Primary Examiner* — Mark A Williams

(74) *Attorney, Agent, or Firm* — Manelli Selter PLLC; Edward Stemberger

(57) ABSTRACT

A tool box or tool cabinet (hereafter: "tool box") is provided with a locking mechanism having a locked condition in which it prevents access to tools within the tool box, and an unlocked condition in which it allows access to tools within the tool box. An electric motor has a rotor, and is provided with a microprocessor and control circuit, coupled to the motor for controlling it. The microprocessor is adapted to receive Bluetooth signals when paired to a user's portable Bluetooth-enabled mobile device, The microprocessor and control circuit are effective, when the user's portable Bluetooth-enabled mobile device is sufficiently close to the control circuit to be detected, to energise the motor to rotate the rotor in a first sense, effective to disable the locking mechanism to allow access to the tools.

11 Claims, 9 Drawing Sheets

(56) References Cited

U.S. PATENT DOCUMENTS

| | | | | |
|---|---|---|---|---|
| 2019/0145130 | A1* | 5/2019 | Affan | E05B 47/026 292/144 |
| 2019/0323265 | A1* | 10/2019 | Robillard | E05B 65/0021 |

FOREIGN PATENT DOCUMENTS

| | | | | |
|---|---|---|---|---|
| CN | 206140447 | U | * | 5/2017 |
| CN | 206140448 | U | * | 5/2017 |
| DE | 102017127440 | A1 | * | 5/2019 |

* cited by examiner

LOCKING AND UNLOCKING TOOL BOXES AND TOOL CABINETS

FIELD OF THE DISCLOSURE

This disclosure relates to locking and unlocking of tool boxes and tool cabinets.

BACKGROUND TO THE DISCLOSURE

Skilled tradesmen in many trades need a wide selection of tools. These are commonly housed in liftable boxes or wheeled cabinets, which, in either case, will typically comprise a chest with an open or openable front, mounting a plurality of shallow drawers that slide in and out, individual tools being placed in these drawers. For convenience, we refer to "tool boxes" in the following description, but it should be understood that this term is intended to encompass, tool boxes, tool cabinets and tool chests of all kinds. Although conventional tool boxes will often be provided with a locking mechanism, a tradesman will usually leave his box unlocked while working, as it is often impractical to keep locking and unlocking the box.

In a typical large workplace there will be several tradesmen with their own tool boxes. One tradesman in need of a particular tool for a particular task may borrow it from another tradesman's cabinet. The borrowed tools are not always returned.

SUMMARY OF THE DISCLOSURE

The present disclosure has arisen from our work seeking to provide greater security for a particular tradesman's tools, without them needing repeatedly to lock and unlock their tool box or cabinet with a key. As explained in detail below, we provide practical embodiments of system for locking and unlocking a conventional tool box that can be fitted to an existing tool box.

In accordance with a first aspect of the present disclosure, there is provided a tool box provided with: (i) a locking mechanism having a locked condition in which it prevents access to tools within the tool box, and an unlocked condition in which it allows access to tools within the tool box; (ii) an electric motor, the motor having a rotor; and (iii) a microprocessor and control circuit, coupled to the motor for controlling it, and adapted to receive Bluetooth signals when paired to a user's portable Bluetooth-enabled mobile device, the microprocessor and control circuit being effective, when the user's portable Bluetooth-enabled mobile device is sufficiently close to the control circuit to be detected, to energise the motor to rotate the rotor in a first sense, effective to disable the locking mechanism to allow access to said tools.

Examples of portable Bluetooth-enabled mobile devices include tablet computers, portable music players and mobile phones.

The microprocessor may be effective, when a previously detected user's portable Bluetooth-enabled mobile device is no longer detected, to energise the motor to rotate the rotor in the opposite sense, to cause the locking mechanism to return to a locked condition. Alternatively, the microprocessor may be effective, when a previously detected user's portable Bluetooth-enabled mobile device is no longer detected, to disengage the rotor from the disabled locking mechanism, allowing the locking mechanism to return to a locked condition.

Preferred embodiments have one or more of the following features: The tool box is of the kind in which individual drawers for holding tools are slidable generally horizontally in and out of the tool box, each said drawer being formed with or provided with a hook at its rear end, and the locking mechanism comprises at least one lock bar mounted on a rear wall of the tool box, the lock bar being slidable vertically between a lower position in which it is adapted to prevent passage of a said hook through a corresponding opening in the lock bar, thereby preventing sliding of the drawer, and a raised position in which passage of said hook through said opening is allowed, so that the drawer is slidable out of the tool box. A pawl of a pawl-and-ratchet mechanism is mounted on the rotor, and the ratchet is mounted on a horizontally slidable member, whereby rotation of the rotor in said first sense causes horizontal linear motion of the slidable member to cause a camming action of the member against a vertically movable member coupled to the lock bar, thereby causing the vertically movable member to move the lock bar to its raised position. Rotation of the rotor in the opposite sense from an unlocked condition causes horizontal liner motion of the slidable member to disengage the camming action and allow the lock bar to return to its lower position under gravity. Alternatively, a pawl of a pawl-and-ratchet mechanism is mounted on the rotor, and the ratchet is mounted on a vertically slidable member, whereby rotation of the rotor in said first sense causes vertical linear motion of the slidable member to directly push the lock bar or a mechanism linked to the lock bar in a direction to raise the lock bar. Rotation of the rotor in the opposite sense from an unlocked condition causes vertically downwards liner motion of the slidable member to allow the lock bar to return to its lower position under gravity. There are a plurality of lock bars mounted on the rear wall of the tool box, linked by a mechanism so that all of the lock bars are raised together to their raised position. In an alternative arrangement, in which there are a plurality of lock bars mounted on the rear wall of the tool box, with a link mechanism coupling the upper ends of the respective lock bars so that they rise and fall together, the vertically slidable member may be positioned to engage the link mechanism from below, whereby rotation of the rotor in said first sense causes vertical linear motion of the slidable member to engage the link mechanism and raise the lock bars together to their raised position. Rotation of the rotor in the opposite sense from an unlocked condition causes vertically downwards linear motion of the slidable member to allow the lock bars to return to their lower positions under gravity.

The electric motor and microprocessor may be provided as a conversion kit for existing tool boxes, and are adapted to be coupled to the existing locking mechanism of an existing tool box without permanent fixings.

In one arrangement, a tool box has an inside bottom surface, with a pair of angle irons, each comprising a first flange coupled to a second flange at a right-angle to the first, mounted to the rear wall of the tool box by their first flanges. The lock bar is vertically slidable between the respective second flanges of the angle irons which act together as a pair of guide rails for the lock bar. The conversion kit is located in position on the inside bottom surface of the tool box by two fingers of the kit that form a push fit outwardly of the respective guide rails.

In an alternative arrangement, a tool box has vertical banks of drawers with space between the vertical banks, and a plurality of lockbars. A conversion kit is adapted to fit against the rear wall of the tool box between the vertical banks and comprises a vertically moveable lifting arm positioned to engage either one of the lock bars or a linking mechanism linking the lock bars.

BRIEF DESCRIPTION OF THE DRAWINGS

Reference will now be made by way of example only to the accompanying drawings, in which parts of the tool box are omitted from the drawings in order better to understand the locking and unlocking systems incorporated into the tool box. In the drawings.

DESCRIPTION OF PREFERRED EMBODIMENTS

In order to understand how the teachings of the present disclosure are applied to embodiments of tool box, it is first necessary to understand how conventional tool boxes and cabinets are locked and unlocked.

Reference is first made to FIGS. 1 to 4, which illustrate a locking mechanism for typical conventional tool boxes and cabinets. Although the components illustrated relate to tool boxes and cabinets available from Snap-On Tools of Kettering NN16 8SN in the United Kingdom, and from other Snap-On Tools franchisees in other countries, tool boxes and cabinets from other suppliers employ similar mechanisms.

Figure 1:
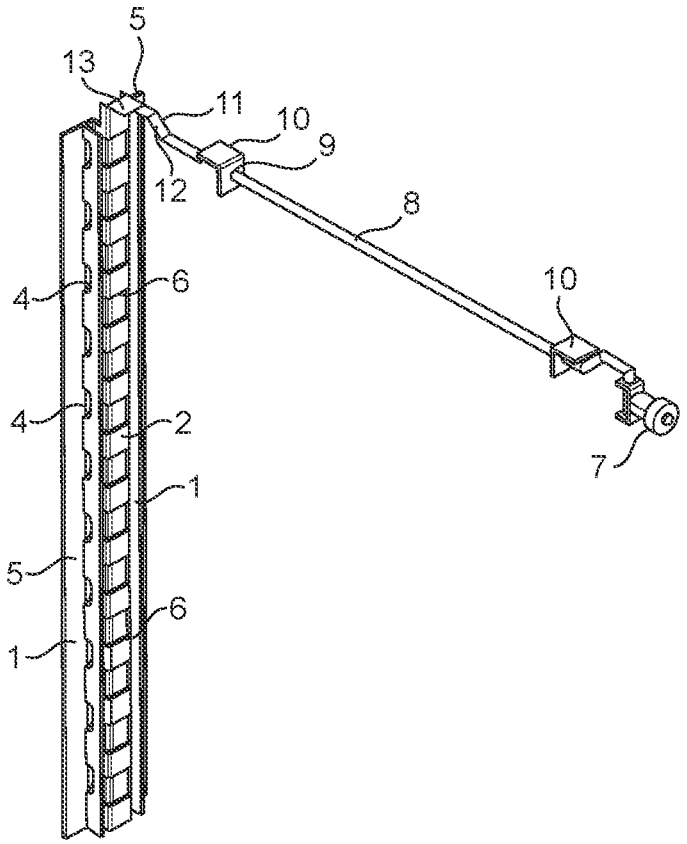
FIG. 1 is a perspective view of components of a locking mechanism for a relatively small conventional tool box.
Figure 2:
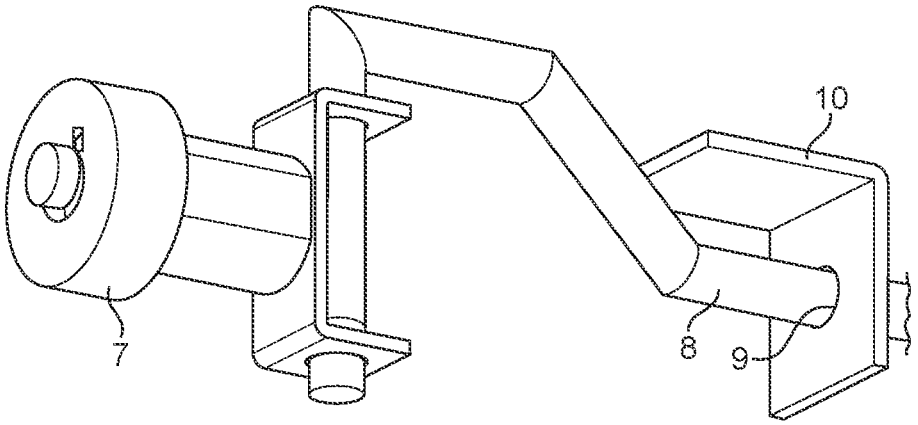
FIG. 2 is an enlarged perspective view of a barrel lock and related components in the mechanism of FIG. 1.
Figure 3:
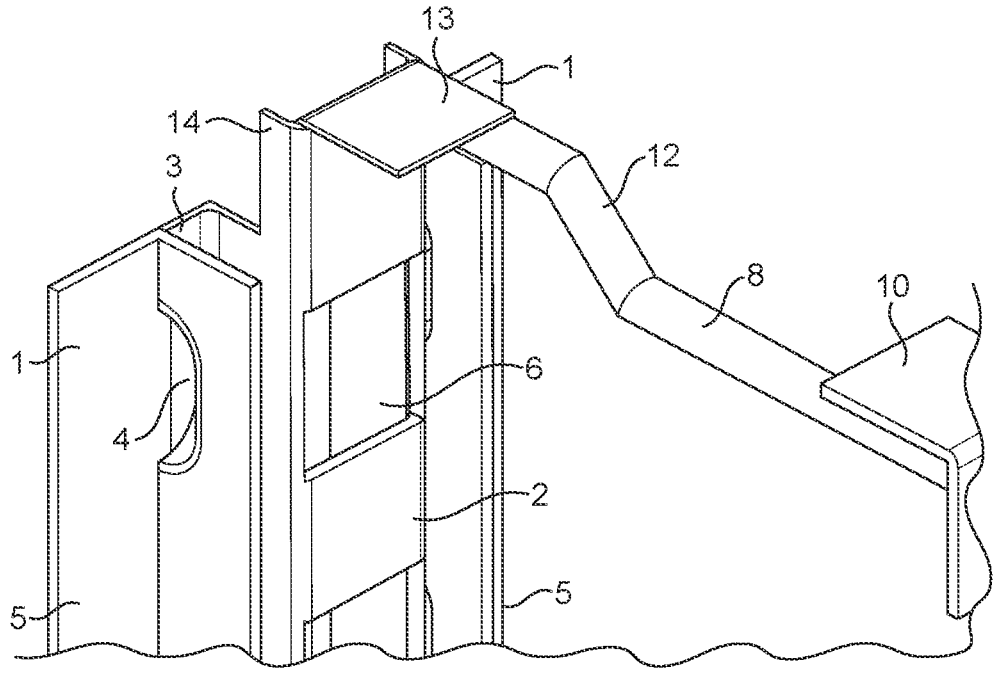
FIG. 3 is an enlarged scrap perspective view showing co-operation between a lock rod and a lock bar of the mechanism of FIG. 1.

FIGS. 1 to 3 show a locking mechanism for a small tool box. A pair of angle irons 1 are fixedly mounted to extend vertically on the inside rear wall W of the tool box (not shown in this view, but visible in FIGS. 8, 9 and 10). A lock bar 2 has flanges 3 trapped behind a plurality of aligned abutments 4 punched out of one wall of the angle iron 1 so that the flanges 3 of the lock bar 2 are vertically slidable behind the abutments 4. Thus, the angle irons serve as guide rails 5 for the lock bar 2. The lock bar 2 has a plurality of openings 6 therethrough. When the lock bar 2 is in a raised position, respective hooks formed or mounted on the rear edge of each slidable drawer (not shown in this view, but see FIG. 8 at 35) of the tool box can pass freely through a correspondingly positioned opening 6 from behind the lock bar 2, allowing the drawer to be slid out of the tool box, thereby providing access to the tools stored on that drawer. When the lock bar 2 is in its lower position, the respective hooks are trapped behind the lock bar 2 and cannot pass through their openings 6, thus preventing the drawers from being slid out. The lock bar 2 is controlled by a barrel lock 7 mounted on the front of the tool box. The barrel lock is coupled to one end of an axial lock rod 8 the axis of which coincides with the axis of the barrel lock. Axial lock rod 8 is rotatably mounted in bushes 9 provided as openings in angled members 10 fastened to the inside of the lid of the box. The other end 11 of the axial lock rod 8 is cranked at 12 and engages a tab 13 on upper end 14 of lock bar 2. As will be appreciated in the arrangement illustrated, rotation of the barrel lock 7 is enabled when its key is inserted. Rotation in a clockwise sense from a position in which the crank 12 lies in a horizontal plane will cause rotation of the axial lock rod 8 so that its cranked end 12 raises lock bar 2 via its tab 13 until the crank lies in a vertical plane. When the axial lock rod 8 is rotated in the opposite sense by 90°, the lock bar 2 is allowed to fall under gravity to trap the hooks on the respective drawers which can no longer pass through their respective openings 6.

Figure 4:
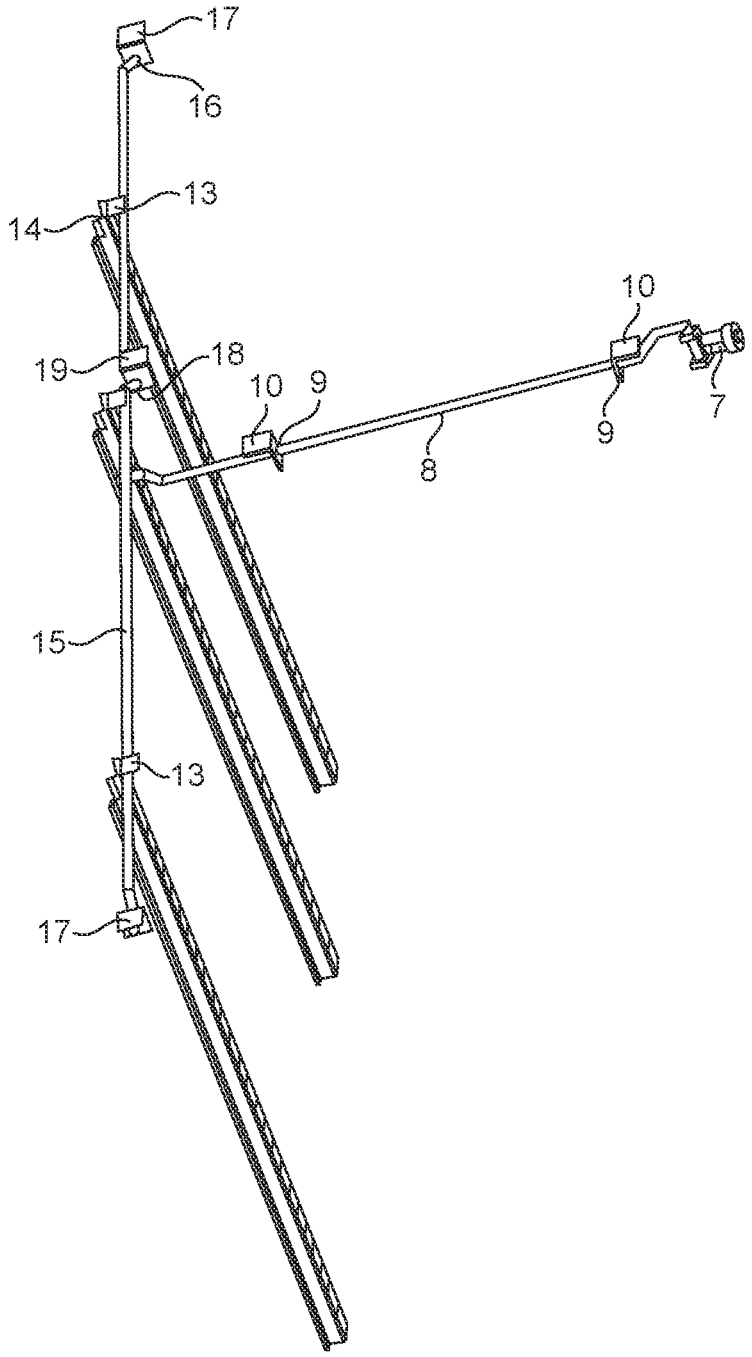
FIG. 4 is a perspective view of components of a locking mechanism for a larger tool cabinet.

Larger tool boxes or wheeled cabinets will suitably be provided with a plurality of lock bars 2. Typically, a variation of the locking mechanism described above is provided for such cabinets, and is illustrated in FIG. 4. In this arrangement, a barrel lock 7 and axial lock rod 8 are provided as before, but rotation of cranked end 12 no longer directly engages the lock bars 2. Instead cranked end 12 engages from below a further cranked rod 15, the ends of which are mounted in bushes 16 provided by openings in angled members 17 fastened to the inside lid of the cabinet. There may also be one or more intermediate bushes 18 also provided by openings in further angled members 19 fastened to the inside of the lid of the cabinet. Cranked rod 15 will rotate as the cranked end 12 of axial lock rod 8 is rotated to the vertical position. The cranked rod 15 engages from below with respective tabs 13 on upper ends 14 of the respective lock bars 2 to raise all of the lock bars simultaneously in their respective guide rails 5.

Figure 5:
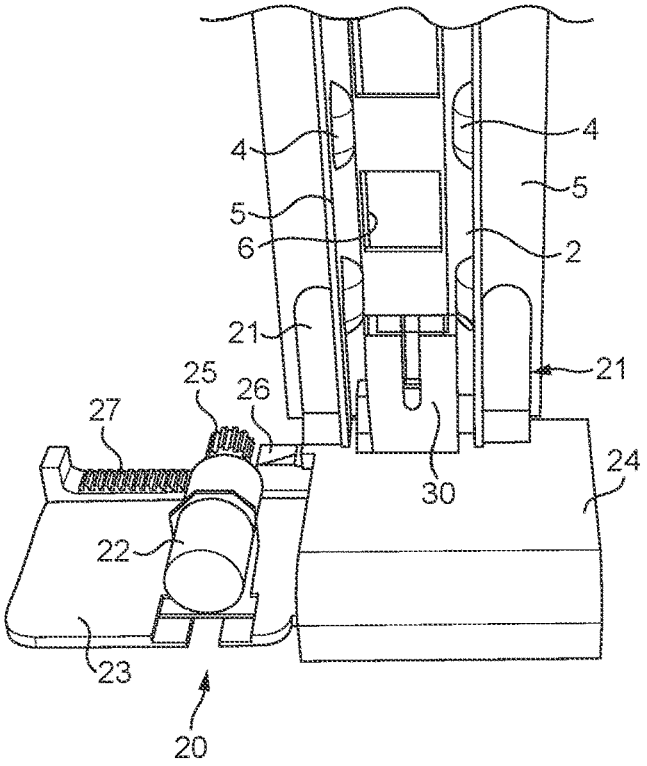
FIG. 5 is a perspective view of a locking/unlocking unit coupled to a lock bar in a first embodiment of tool box incorporating the teachings of the present disclosure.
Figure 6:
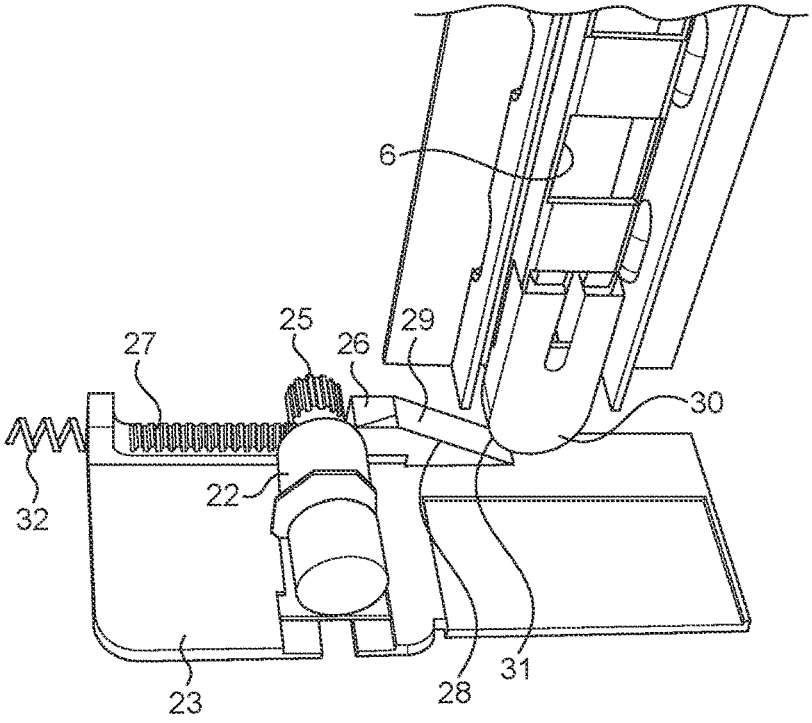
FIG. 6 is a perspective view of parts of the apparatus shown in FIG. 5.

Turning now to FIG. 5, which illustrates a first embodiment in accordance with the teachings of the present disclosure, a locking/unlocking unit 20 sits on the floor of a tool box adjacent its rear wall in space below the lowermost drawer and is located relative to a lock bar 2 by means of fingers 21 either side of the guide rails 5. A small electric motor 22 is fixedly mounted to base 23 of the unit 20 and is driven by a battery (not shown) or by connection to mains electricity via a transformer and rectifier (also not shown), under control of a microprocessor and control circuit housed in housing 24, which control the motor. Pawl 25 of a pawl-and-ratchet mechanism is mounted on the rotor of motor 22. As best shown in FIG. 6, which omits the housing 24 and related components for clarity, rotation of the rotor in the counter-clockwise sense will cause a slidable member 26 on which ratchet 27 is formed to slide to the right in FIG. 6. A wedge member 28 with a sloping surface 29 is formed on the slidable member 26 and engages a lifting block 30 which forms a push fit into the lowermost opening 6 of lock bar 2. The resultant camming motion of wedge member 28 against side surface 31 of lifting block 30 as the slidable member 26 moves to the right in FIG. 6 pushes lifting block 30 upwards, taking with it lock bar 2. Optionally, a coil spring 32 may engage the left-hand end of the slidable member 26 as shown in FIG. 6 to assist the motor 22 in moving the slidable member 26 to the right in FIG. 6 and to raise lifting block 30 and lock bar 2. Subsequent rotation of the rotor in the opposite clockwise sense will withdraw slidable member 26 to the left against the bias of the coil spring 32, if present, disengaging wedge member 28 from lifting block 30 allowing the lock bar to slide downwards under gravity in its guide rails 5.

It will be appreciated that the locking/unlocking unit may be supplied as a conversion kit for an existing toolbox. No permanent fixings are required since the unit is located by means of its fingers 21 on the outward sides of the guide rails for the lock bar as a push fit.

Figure 7:
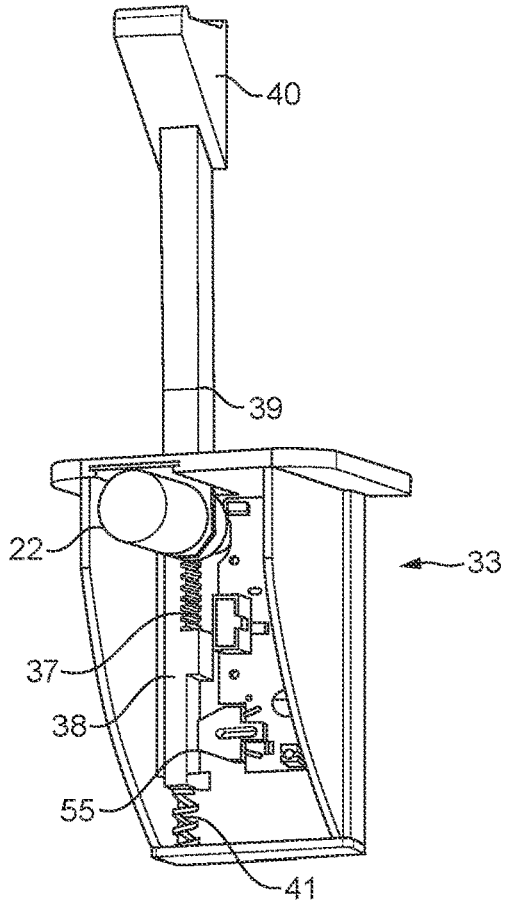
FIG. 7 is a perspective view of a locking/unlocking unit in an alternative embodiment of tool box also incorporating the teachings of the present disclosure.
Figure 8:
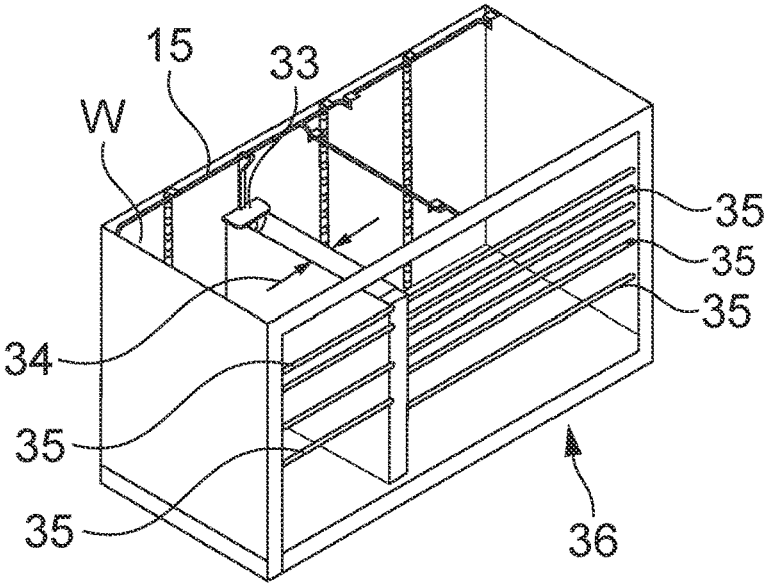
FIG. 8 is a perspective view on a reduced scale illustrating how the unit of FIG. 7 may be accommodated in a tool box.

However, in some tool boxes, there may be insufficient space beneath the lowermost drawer to accommodate the locking/unlocking unit illustrated in FIGS. 5 and 6. The alternative embodiment of locking/unlocking unit 33 shown in FIG. 7 may be employed provided that there is a sufficiently wide cavity 34 for accommodating it between parallel vertical banks of horizontally sliding drawers 35 in a tool box 36 (FIG. 8). It will again be noted that the unit does not require any permanent fixings to locate it in position, and so may be provided as a conversion kit for an existing tool box with vertical banks of horizontal sliding drawers. Motor 22 is mounted so that the pawl (not visible in this view) mounted on its rotor engages a ratchet 37 on a vertically slidable member 38 coupled to a lifting arm 39, formed in sections to accommodate differently sized tool boxes, upper end 40 of which lifting arm engages with a lock bar or with a link mechanism such as cranked rod 15 described above, which links a plurality of lock bars so that they rise together when the rotor rotates in a clockwise sense in the view of FIG. 7 and fall under their own weight when upper end 40 is withdrawn by the rotor rotating in the opposite counter-clockwise sense. Vertical motion of slidable member 38 and lifting arm 39 by motor 22 to lift a lock bar or a plurality of linked lock bars may be enhanced by a coil spring 41.

Figure 9:
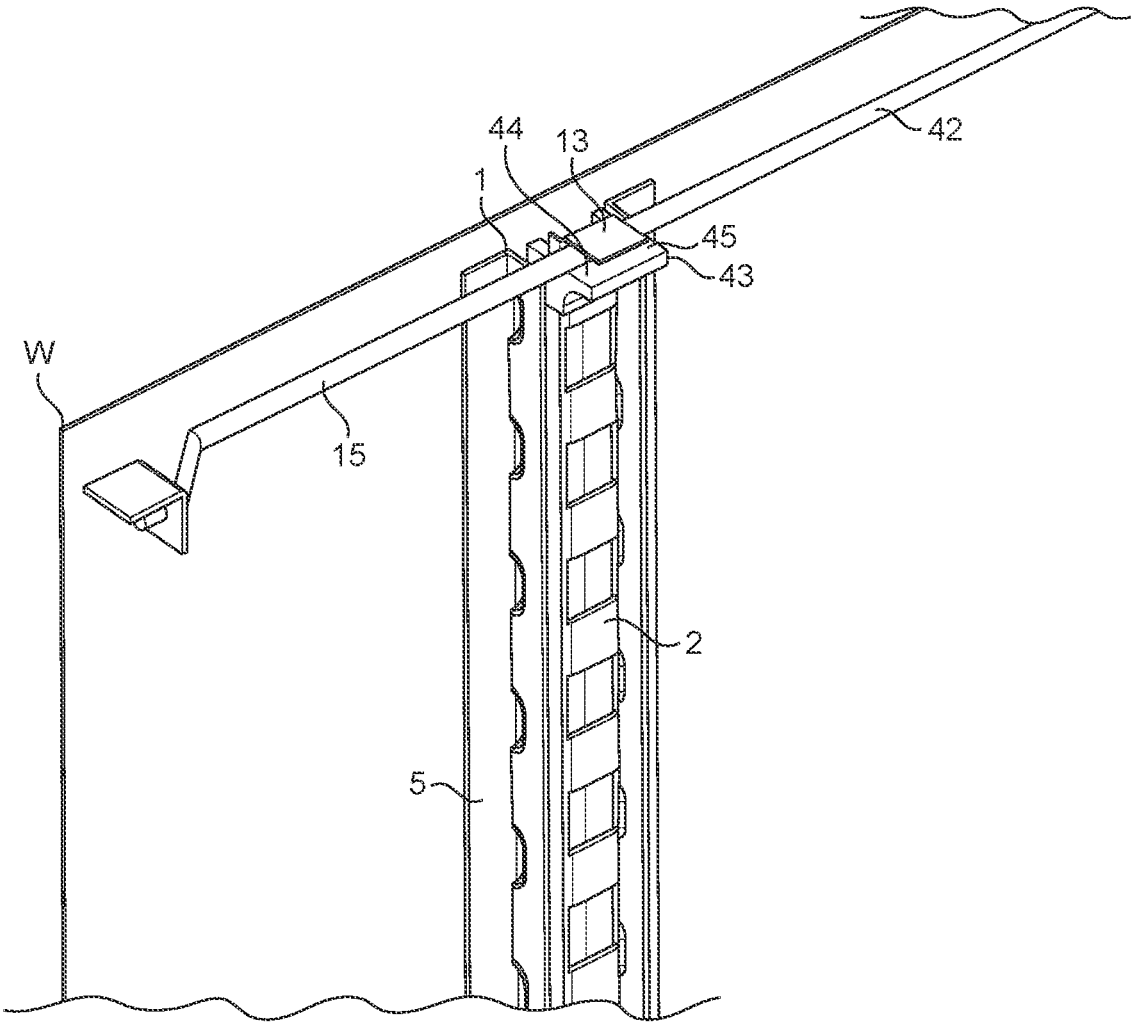
FIG. 9 is a perspective view showing how a lock bar may be positively coupled to a link mechanism linking the tops of a plurality of lock bars so that they move together to lock or unlock the tool box.
Figure 10:
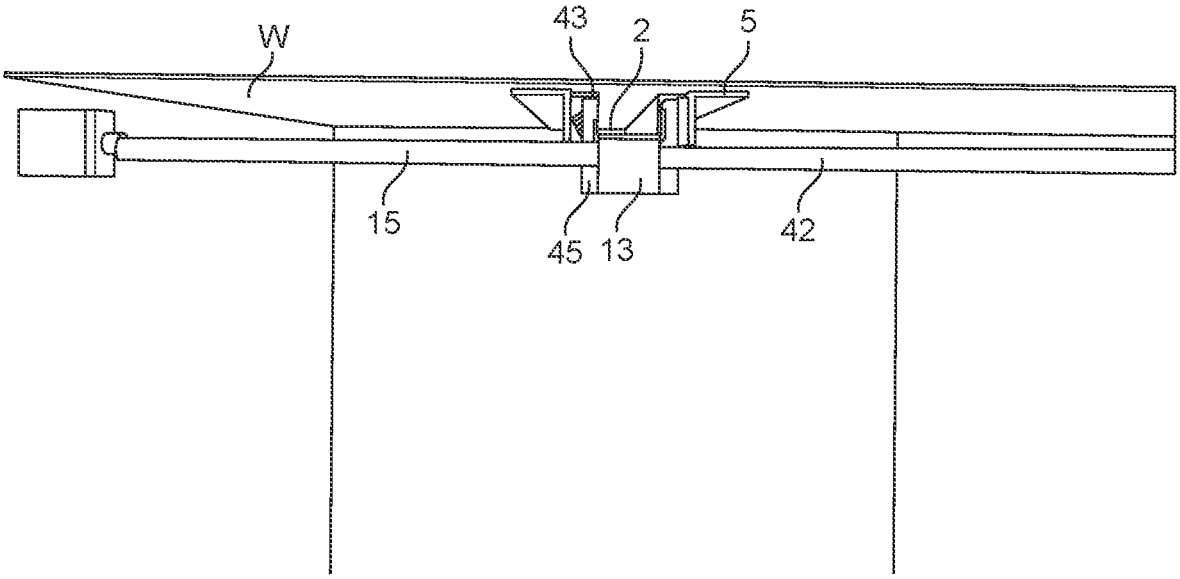
FIG. 10 is a view from above of the apparatus shown in FIG. 9.

When the tool box has a plurality of lock bars, rather than simply engaging a link mechanism 42 for the lock bars, such as cranked rod 15, from below to raise the lock bars together and allowing the lock bars to subsequently slide downwardly individually under gravity back to a locked condition, the lock bars may be positively coupled to the link mechanism 42 as shown in FIGS. 9 and 10. In this arrangement a top clip 43 is clipped to an upper region of the lock bar 2 below the tab 13 so that a space 44 remains between horizontal surface 45 of the clip and the underside of tab 13 to accommodate the link mechanism 42, here cranked rod 15.

Figure 11:
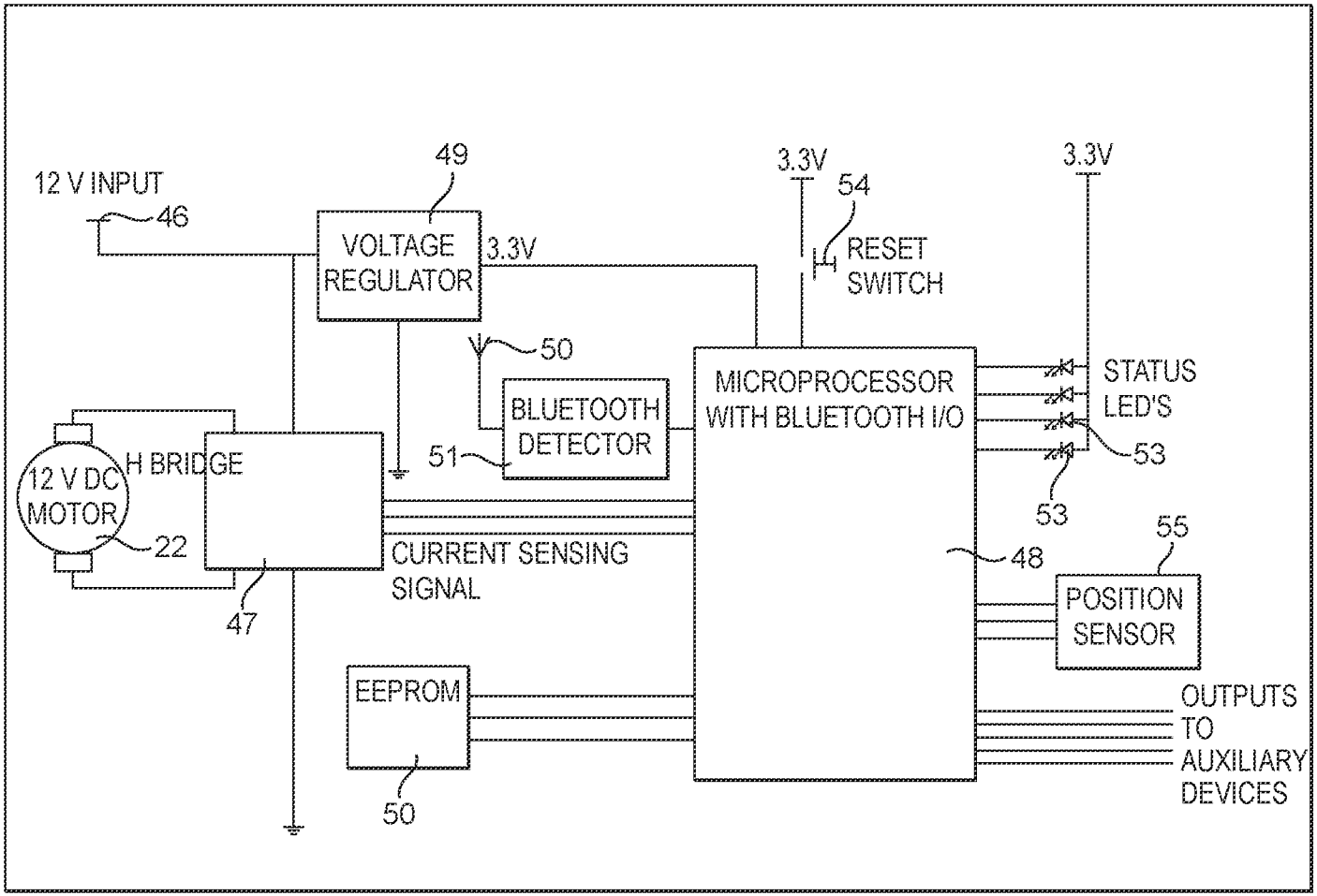
FIG. 11 is a circuit diagram for a microprocessor and control circuit for controlled locking and unlocking of a tool box in one embodiment following the teachings of this disclosure.
Figure 12:
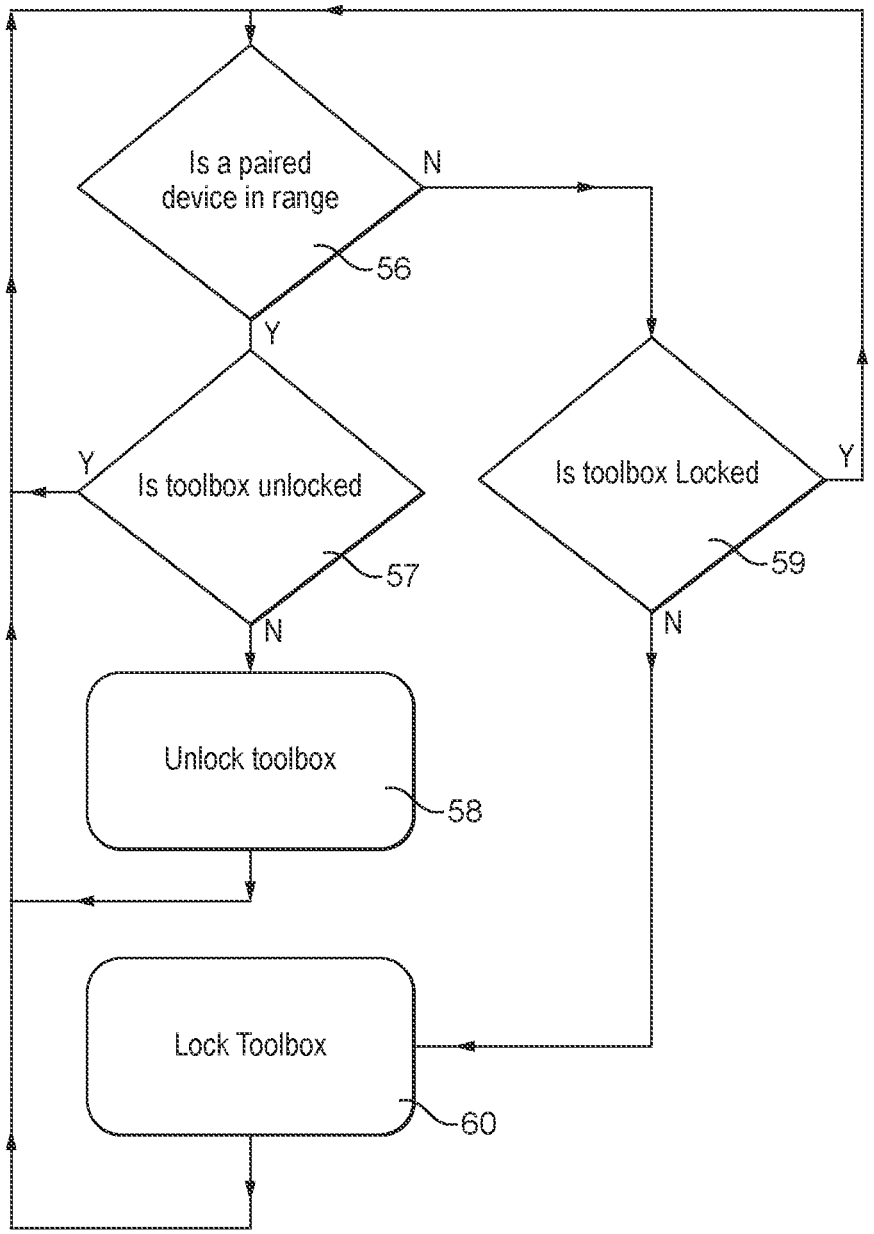
FIG. 12 is a logic flow diagram explaining how locking and unlocking of a tool box in accordance with the teachings of the present disclosure may be controlled.

Reference may now be made to the circuit diagram of FIG. 11 and the logic flow diagram of FIG. 12 to explain how the locking/unlocking units 20 and 33 are controlled.

Motor 22 is coupled to a 12 volt DC power supply 46 (which may be provided by a battery or by a transformer and rectifier linked to mains electricity) via an H-bridge motor controller 47, which is in turn controlled by microprocessor 48 so that motor 22 may be driven in either sense. Microprocessor 48 is also powered from power supply 46 via a voltage regulator 49, and is coupled to an aerial 50 and Bluetooth detector 51, an EEPROM memory 52, a plurality of status LEDs 53 allowing the status of the system to be immediately visible on inspection, a reset switch 54, and a position sensor 55 for a purpose to be explained.

Microprocessor 48 is programmed to periodically follow the logic flow diagram of FIG. 12. It must first be paired with the user's Bluetooth-enabled portable mobile device, details of which are stored in memory 50. If a paired device is detected at step 56, the microprocessor 48 checks whether the tool box is unlocked at step 57. If it is, the program returns to its start. If it is not unlocked, the microprocessor 48 unlocks the tool box in step 58 by energising the motor 22 to rotate in the direction that causes slidable member 28 to move to the right in the embodiment of FIGS. 5 and 6 to engage lifting block 30 or to move slidable member 38 to move vertically to raise lifting arm 39 in the embodiment of FIG. 7, until position sensor 55 detects that the slidable member 26 or the lifting arm 38 have moved sufficiently for the tool box to be unlocked. The position sensor 55 is visible in FIG. 7 and is preferably an infra-red proximity sensor actuated by reflected infra-red light reflected by a reflective strip mounted on the slidable member 38. A similar position sensor will be present in the embodiment of FIGS. 5 and 6 but was omitted for clarity. When step 58 is complete the program returns to its start.

If no paired device is detected in step 56, the microprocessor 48 checks whether the tool box is locked in step 59. If it is, the program returns to its start. If it is not locked, the microprocessor 46 locks the tool box in step 60 by rotating the motor 22 in the opposite direction to slide slidable member 26 to the left in the embodiment of FIG. 6 until stopped by position sensor 55, or to lower slidable member 37 until stopped by position sensor 55, to allow the respective lock bars 2 to slide downwardly under gravity to lock the drawers of the tool box from being slid out. On completion of step 60, the program returns to its start.

It will be readily appreciated that the teachings of the present disclosure, in particular, in relation to controlled locking and unlocking, can equally well be applied to other forms of tool box in which the locking mechanism itself is quite different. In all such cases, provided that the user of the tool box keeps their paired Bluetooth-enabled mobile device with them at all times, the tool box will always be unlocked and the tools within readily available when the authorised user of the tool box is present in the vicinity of the tool box as judged by that user's Bluetooth-enabled mobile device being detected by the microprocessor, and always locked when the authorised user of the tool box is absent.

The invention claimed is:

1. A lock conversion kit adapted to be fitted to a tool box that already has a locking mechanism pre-fitted to the tool box as supplied and operable by a main locking unit also pre-fitted to the tool box as supplied, said locking mechanism having a locked condition preventing access to tools within said tool box, and an unlocked condition allowing access to tools within said tool box, the lock conversion kit comprising:

an electric motor, the motor having a rotor; and a microprocessor and control circuit, coupled to the motor for controlling the motor, and configured to receive Bluetooth signals when paired to a user's portable Bluetooth-enabled mobile device, the microprocessor and control circuit being effective, when the user's portable Bluetooth-enabled mobile device is sufficiently close to the control circuit to be detected, to energise the motor to rotate the rotor in a first sense, effective to disable the locking mechanism to allow access to said tools, wherein the lock conversion kit, when fitted to the tool box, is configured to engage said locking mechanism and is configured to over-ride the operation of said main locking unit.

2. A lock conversion kit according to claim 1, wherein the microprocessor is effective, when a previously detected user's portable Bluetooth-enabled mobile device is no longer detected, to energise the motor to rotate the rotor in the opposite sense, to cause the locking mechanism to return to a locked condition.

3. A lock conversion kit according to claim 1, wherein the microprocessor is effective, when a previously detected user's portable Bluetooth-enabled mobile device is no longer detected, to disengage the rotor from the disabled locking mechanism, allowing the locking mechanism to return to a locked condition.

4. A lock conversion kit according to claim 1, in combination with the tool box, wherein the tool box is of the kind in which individual drawers for holding tools are slidable generally horizontally in and out of the tool box, each said drawer having a front and rear end and being formed with or provided with a hook at the rear end, and wherein the locking mechanism comprises at least one lock bar mounted on a rear wall of the tool box, the lock bar being slidable vertically between a lower position in which it is adapted to prevent passage of said hook through a corresponding opening in the lock bar, thereby preventing sliding of the drawer, and a raised position in which passage of said hook through said opening is allowed, so that the drawer is slidable out of the tool box, and the lock conversion kit comprises a pawl-and-ratchet mechanism that serves to raise and lower the lock bar.

5. A lock conversion kit and tool box combination according to claim 4, wherein a pawl of the pawl-and-ratchet mechanism is mounted on the rotor, and the ratchet is mounted on a horizontally slidable member, whereby rotation of the rotor in said first sense causes horizontal linear motion of the slidable member to cause a camming action of the member against a vertically movable member coupled to the lock bar, thereby causing the vertically movable member to move the lock bar to its raised position, and rotation of the rotor in the opposite sense from an unlocked condition causes horizontal liner motion of the slidable member to disengage the camming action and allow the lock bar to return to its lower position under gravity.

6. A lock conversion kit and tool box combination according to claim 4, wherein a pawl of the pawl-and-ratchet mechanism is mounted on the rotor, and the ratchet is mounted on a vertically slidable member, whereby rotation of the rotor in said first sense causes vertical linear motion of the slidable member to directly push the lock bar or a mechanism linked to the lock bar in a direction to raise the lock bar, and rotation of the rotor in the opposite sense from an unlocked condition causes vertically downwards liner motion of the slidable member to allow the lock bar to return to its lower position under gravity.

7. A lock conversion kit and tool box combination according to claim 4, wherein there are a plurality of lock bars mounted on the rear wall of the tool box, linked by a mechanism so that all of the lock bars are raised together to their raised position.

8. A lock conversion and tool box combination according to claim 7, wherein a link mechanism couples the upper ends of the respective lock bars so that they rise and fall together, a pawl of a pawl-and-ratchet mechanism is mounted on the rotor, and the ratchet is mounted on a vertically slidable member positioned to engage the link mechanism from below, whereby rotation of the rotor in said first sense causes vertical linear motion of the slidable member to engage the link mechanism and raise the lock bars together to their raised position, and rotation of the rotor in the opposite sense from an unlocked condition causes vertically downwards linear motion of the slidable member to allow the lock bars to return to their lower positions under gravity.

9. A lock conversion kit according to claim 1, wherein the electric motor and microprocessor are adapted to be engaged with to the existing locking mechanism of the tool box without permanent fixings.

10. A lock conversion kit and tool box combination according to claim 5, wherein the tool box has an inside bottom surface, wherein a pair of angle irons, each comprising a first flange coupled to a second flange at a right-angle to the first, are mounted to the rear wall of the tool box by their first flanges, and the lock bar is vertically slidable between the respective second flanges of the angle irons which act together as a pair of guide rails for the lock bar; and the conversion kit comprising the electric motor and microprocessor being located in position on the inside bottom surface of the tool box by two fingers of said kit that form a push fit outwardly of the respective guide rails.

11. A lock conversion kit and tool box combination according to claim 7, wherein the tool box has vertical banks of drawers with space between the vertical banks; and the conversion kit being adapted to fit against the rear wall of the tool box between the vertical banks, and comprising a vertically moveable lifting arm positioned to engage either one of the lock bars or the linking mechanism.

* * * * *